United States Patent [19]

Braun et al.

[11] 3,982,651

[45] Sept. 28, 1976

[54] CONTAINER AND CLOSURE CAP THEREFOR

[75] Inventors: Morris Braun; John M. Gerty, Jr., both of Chicago, Ill.; George B. Spransy, Oconomowoc, Wis.

[73] Assignee: W. Braun Company, Chicago, Ill.

[22] Filed: Nov. 18, 1974

[21] Appl. No.: 524,650

[52] U.S. Cl. ..... 220/4 B; 220/4 E; 220/260; 220/306

[51] Int. Cl.[2] ..... B65D 11/02; B65D 43/10

[58] Field of Search ..... 220/4 B, 4 E, 306, 352, 220/260; 150/.5; 215/1 C

[56] References Cited

UNITED STATES PATENTS

| | | | |
|---|---|---|---|
| 3,004,684 | 10/1961 | Lightburn | 220/260 |
| 3,032,228 | 5/1962 | Andrews | 220/4 E |
| 3,244,272 | 4/1966 | Beaman | 220/306 |
| 3,252,446 | 5/1966 | Bateman | 220/352 |
| 3,372,834 | 3/1968 | Ayotte | 220/306 |

*Primary Examiner*—George E. Lowrance
*Attorney, Agent, or Firm*—Max R. Kraus

[57] ABSTRACT

A container and closure cap therefor which forms a package unit, with the container having an open top, a continuous sinuous surface adjacent the open top, the sinuous surface including rounded projections merging into adjacent rounded recesses, a closure cap for the container, the cap having a skirt and an open bottom with a continuous sinuous surface on the skirt, the last mentioned sinuous surface shaped complementary to the container sinuous surface so that the sinuous surface of the closure cap is adapted to engage the container sinuous surface with the projection of one positioned in the recesses of the other when the closure cap is in closing position, one or the other of said closure cap and container having an annular wall portion offset inwardly of its respective sinuous surface and adapted to interfit within the other of the closure cap or container adjacent its sinuous surface to frictionally secure the closure cap to the container. Rotation of the cap with respect to the container will cause the projections of the sinuous surface of the closure cap to move out of the recesses of the container to dislodge the cap from the container.

3 Claims, 6 Drawing Figures

CONTAINER AND CLOSURE CAP THEREFOR

BRIEF DESCRIPTION OF THE INVENTION

This invention relates to a package unit and more particularly to a container and a closure cap therefor constructed of relatively inexpensive material and may be inexpensively molded.

An object of this invention is to provide a container and a closure cap therefor, each with a sinuous shaped portion or surface where the high points or projections of one mate with the recesses of the other in mating engagement when the cover is secured to the container to provide a smooth surface at such mating surfaces and wherein either one or the other of said cap or container has a portion which is received in the other to frictionally retain the cap in closed position on the container, and wherein by rotation of the cap relative to the container the sinuous portions or surfaces in effect serve as camming means so that the cap disengages from the container.

Another object of this invention is to provide a container and a cap or closure therefor which eliminates the use of screw threads on either the cap or container and eliminates the conventional screwing of the cap on the container and in lieu thereof provides means whereby the cap may be readily secured to the container and may be readily detached therefrom and which presents an attractive package.

Another object of this invention is to provide the cap and container with a bead and a cooperating groove to more securely fasten the cap to the container.

BRIEF DESCRIPTION OF THE DRAWINGS

In the drawings:

FIGS. 1, 2 and 3

Figure 1:
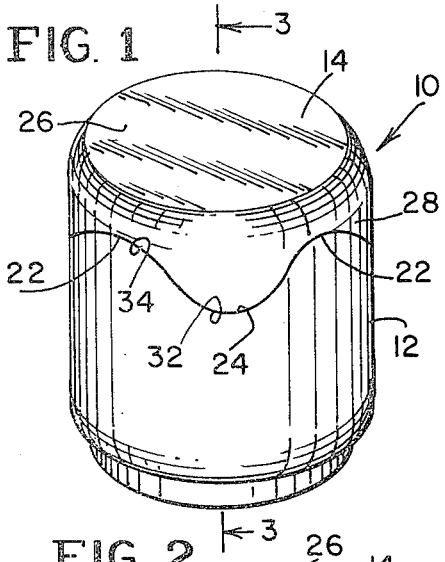
FIG. 1 is a cap and container formed in accordance with this invention and showing the cap in closure position.
Figure 2:
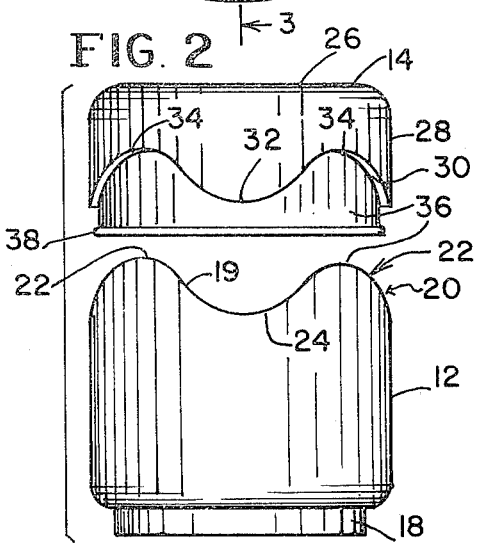
FIG. 2 is an exploded view of the cap and container of FIG. 1.
Figure 3:
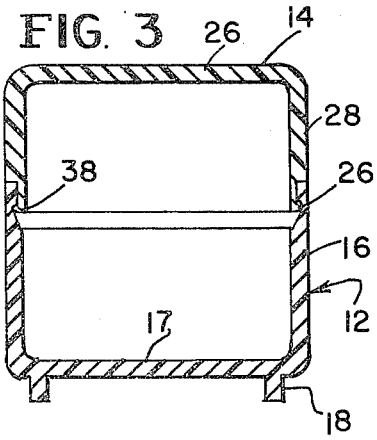
FIG. 3 is a sectional view taken on line 3—3 of FIG. 1.

The structure shown in FIGS. 1, 2 and 3 will be first described. The entire unit is generally indicated at 10 and comprises a container generally indicated at 12 and a closure cap generally indicated at 14, both of which are preferably molded of plastic but may also be formed of glass. The body 16 of the container is circular in cross-section and has a bottom 17 from which depends a reduced annular bottom ring 18. The top which forms the mouth of of the container is open and the top edge or rim 19 of the container has a continuous and uninterrupted sinuous portion or sinuous surface generally indicated at 20. The said sinuous portion or sinuous upper edge 20 comprises a series of spaced rounded projections or raised rounded surfaces 22 which merge into a series of spaced rounded dips or recesses 24. To form the continuous sinuous edge every rounded projection 22 merges into a rounded dip or recess 24 so that the series of spaced projections 22 alternate with the series of recessed portions 24. An annular groove 26 is formed in the inside wall of the container slightly below the curved recesses 24, as best seen in FIG. 3.

The cap or closure generally indicated at 14 is of annular shape and comprises a top end wall 26 with an annular depending skirt generally indicated at 28. The skirt has a sinuous portion or sinuous surface generally indicated at 30, shaped similar to the sinuous portion 20 of the top edge of the container. The sinuous portion or surface 30 on the skirt of the cap comprises a series of rounded projections 32 merging into rounded dips or recesses 34. The skirt 28 of the cap extends below the sinuous portion 30 of the cap and forms an inwardly offset annular skirt portion 36 which terminates at the bottom edge in an annular bead 38 which is adapted to interlock with the annular groove 26 on the container, as shown in FIG. 3. The sinuous portion or sinuous surface 30 on the skirt 28 of the cap is formed on the thickest wall portion of the skirt of the cap, whereas the inwardly offset portion 36 of the skirt which extends therebelow is the thinner wall portion of the skirt 28.

When the cap is secured to the container, as shown in FIGS. 1 and 3, the series of projections 32 of the cap are received in the series of recesses 24 in the top edge of the container and the series of projections 22 on the rim or top edge of the container are received in the series of recesses 34 in the cap so that the sinuous surface 30 of the cap abuts against the sinuous surface 20 of the container, with the annular inwardly offset portion 36 of the cap frictionally fitting within the upper portion of the container. The bead 38 on the cap will engage the groove 26 on the container to effect a more positive securement. It will be understood however that the frictional engagement of the inwardly offset portion 36 of the skirt 28 of the cap with the inside wall of the container is such that the friction will be sufficient to retain the cap on the container without the bead and groove.

To remove the cap, the cap 14 is manually rotated either clockwise or counterclockwise relative to the container 12 and this will cause the projections 32 on the cap to ride up the recesses 24 on the rim of the container and move the cap axially away from the container so that it can be removed from the container. The two sinuous surfaces serve as camming means to effect disengagement when the cap is rotated. As can best be seen in FIGS. 1 and 3, the sinuous surfaces of the cap and container when in abutting engagement provide an exterior surface which is uniform and smooth and presents a surface which does not jut out exteriorly. In other words, the outside circumference of the upper portion of the skirt 28 is equal to the outside circumference of the body 16 of the container.

Figure 4:
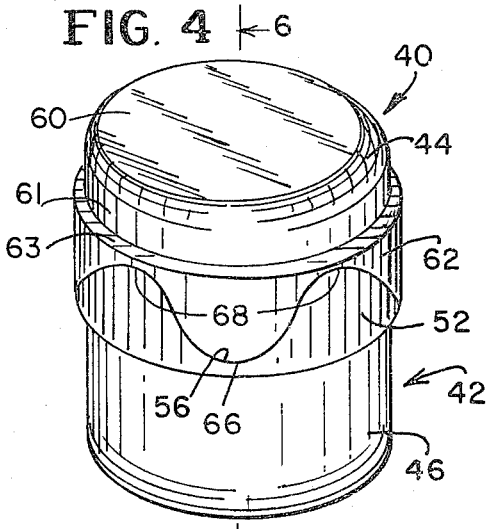
FIG. 4 is a view similar to FIG. 1 but showing a modification.
Figure 5:
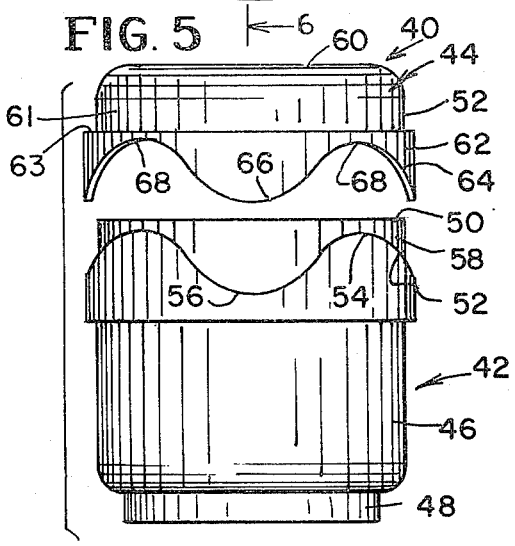
FIG. 5 is an exploded view of FIG. 4.
Figure 6:
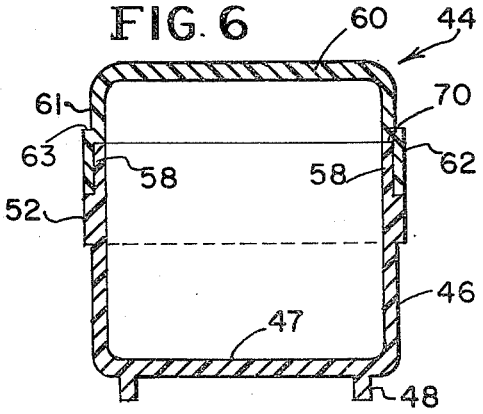
FIG. 6 is a sectional view taken on line 6—6 of FIG. 4.

FIGS. 4, 5 and 6

The modification shown in FIGS. 4, 5 and 6 will now be described. The entire unit is generally indicated at 40 and comprises a container generally indicated at 42 and the closure or cap generally indicated at 44, both of which are preferably molded of plastic but may likewise be formed of glass. The body 46 of the container is circular in cross-section and has a bottom 47 and a reduced annular bottom ring 48. Spaced from the top edge or rim 50 of the open end of the container is a continuous and uninterrupted sinuous portion or sinuous surface generally indicated at 52. Said simuous portion comprises a series of spaced rounded projections 54 which merge into a series of spaced rounded dips or recesses 56. The sinuous portion 52 is offset outwardly from the body 46 of the container and is formed by a thickened wall portion of the body of the container. Extending upwardly of the sinuous portion 52 is an annular upper portion 58, the outside surface of said annular upper portion 58 of the container being substantially on the same vertical plane as the outer surface of the body 46.

The cap or closure 44 is of annular shape and comprises a top end wall 60 with an annular depending skirt generally indicated at 61. The lower portion of the skirt indicated at 62 is offset outwardly from the upper portion of the skirt, with the bottom edge thereof forming a sinuous portion or sinuous surface generally indicated at 64. The sinuous portion 64 of the cap comprises a series of rounded projections 66 merging into rounded dips or recesses 68, similar to that previously described. An annular internal shoulder 63 is formed between the skirt portions 61 and 62 of the cap.

To secure the cap to the container the projections on the sinuous portion or sinuous surface of the cap will interfit with the dips or recesses on the sinuous portion or sinuous surface of the container and the series of recesses on the cap will abut and engage the series of projections on the container, similar to that previously described. While a bead and groove are not shown in this embodiment it will be understood that a bead similar to bead 38 may be formed adjacent the top edge 50 of the portion 58 of the container and an annular groove like groove 26 may be formed adjacent the shoulder 70 of the skirt of the cap so that same will interlock in a similar manner to that shown in FIG. 3. However, as previously described, a bead and groove are not necessary since the frictional contact between the cap and the upper portion 58 of the body of the container should be sufficient to retain the cap in closed position in respect to the container.

The cap 44 is removed in the same manner as previously described and it is rotated either clockwise or counterclockwise in respect to the container and the cap will be dislodged from the container in the same manner as previously described.

While the body of the container is shown to be circular in shape, it will be understood that the body may be of any desired shape, except that the upper portion thereof in which the sinuous portion or sinuous surface is embodied must be of annular shape, that is, while the body of the container may be square, hexagonnal, or any other shape, the upper or neck portion of the bottle would be of annular shape to accommodate the cap, as described.

What is claimed is:

1. A container and closure cap therefor, said container having an open top, a continuous sinuous surface adjacent said open top, said sinuous surface including alternately equally spaced rounded projections merging into adjacent alternately equally spaced rounded recesses, with all parts of said sinuous surface normal to the longitudinal axis of said container, a closure cap for said container, said container having a depth greater than the depth of said closure cap, said closure cap having a skirt and an open bottom, a continuous sinuous surface on said skirt, said continuous sinuous surface on said skirt including alternately equally spaced rounded projections merging into alternately equally spaced adjacent rounded recesses, said last mentioned sinuous surface shaped complementary to said container sinuous surface, with all parts of said last mentioned sinuous surface normal to the longitudinal axis of said closure cap, said closure cap sinuous surface adapted to engage said container sinuous surface with the rounded projections of one positioned in the rounded recesses of the other when the closure cap is in closing position, said closure cap having a short annular wall portion offset inwardly of its respective sinuous surface, with said short annular offset wall portion having an annular bead at the bottom edge thereof and said container having an annular groove to be engaged by said bead when said closure cap is secured to said container, said short annular offset wall portion of said closure cap having an annular free edge which is in close proximity to its respective sinuous surface, said short annular offset wall of said closure cap adapted to interfit within the said container adjacent its sinuous surface to secure said closure cap to said container, said sinuous surfaces of said closure cap and container when in abutting engagement presenting a uniform exterior surface for said closure cap and container at said abutting engagement, rotation of said closure cap with respect to said container causing the projections of the sinuous surface of the closure cap to move out of the recesses of the container to dislodge the closure cap from the container.

2. A container and closure cap as set forth in claim 1 in which the sinuous surface for the container forms the upper edge or rim of the container.

3. A container and closure cap as set forth in claim 1 in which the closure cap and container are each integrally molded of plastic.

* * * * *